United States Patent [19]

Nakagawa et al.

[11] 4,198,884

[45] Apr. 22, 1980

[54] METHOD OF MANUFACTURING A PUNCHING DIE

[75] Inventors: Takeo Nakagawa, No. 2578-1, Noborito, Tama-ku, Kawasaki-shi, Kanagwa-ken, Japan; Kiyoshi Suzuki, Misato, Japan; Hiroyasu Okawa, Mitaka, Japan

[73] Assignees: Aida Engineering, Ltd.; Takeo Nakagawa, both of Kanagawa-ken, Japan

[21] Appl. No.: 892,847

[22] Filed: Apr. 3, 1978

[30] Foreign Application Priority Data

Apr. 1, 1977 [JP] Japan ..... 52/36086

[51] Int. Cl.[2] ..... B21K 5/20

[52] U.S. Cl. ..... 76/107 R; 83/690

[58] Field of Search ..... 83/690; 76/107 R

[56] References Cited

U.S. PATENT DOCUMENTS

| | | | |
|---|---|---|---|
| 522,953 | 7/1894 | Bradley | 83/690 X |
| 2,256,912 | 9/1941 | Welch | 72/107 A X |
| 2,325,989 | 8/1943 | Tryon | 76/107 R |
| 2,547,168 | 4/1951 | Nill et al. | 76/107 R X |
| 2,619,853 | 12/1952 | Lange | 76/107 R |
| 2,623,417 | 12/1952 | Hermann | 76/107 R |
| 2,803,152 | 8/1957 | Wales | 76/107 R |
| 3,256,764 | 6/1966 | Hardy | 83/690 |

*Primary Examiner*—Frank T. Yost

*Attorney, Agent, or Firm*—Armstrong, Nikaido, Marmelstein & Kubovcik

[57] ABSTRACT

A punching die which may be economically produced is disclosed herein. The die is reinforced by superimposing hard thin plates thereon. The punching die is composed of a die body soft enough to be machined and a thin plate, single or plural, which is harder than the die body. The plate has a hole coinciding with a configuration of a product to be punched. The superimposed plate is characterized in that it remains after a product has been punched out from said thin plate by the die body and the punch. The punching die may be easily operated during production. The procedure involves only slight abrasion of the shape. The device is highly durable and precise and operates without causing curvature in the product. Thus, it is suitable for mass production.

6 Claims, 19 Drawing Figures

METHOD OF MANUFACTURING A PUNCHING DIE

BRIEF DESCRIPTION OF THE INVENTION

This invention relates to an economical punching die and, more particularly, to a die reinforced by superimposed thin plates of a hard material thereon and a method for manufacturing the same.

In the prior art, there has been disclosed an easy-punching method of making products of desired configurations. The main components of the device disclosed are a punch and a die. The punch is of a male type and, therefore, easily produced. However, the die is difficult to produce because it is the female component. Therefore, a die conditioned for precision use and having excellent durability has not yet been provided.

Conventional dies may be constructed as follows. First a punch is prepared in a predetermined shape. The punch is positioned in the center of the casting mold, into which the molten zinc alloy is poured and solidified to make a cast metallic die. According to another embodiment, soft steel is machined to form a die opening. In another embodiment, a quenched steel band is bent or curved and fitted into a wooden frame.

In the first two embodiments mentioned above, the material is soft. Therefore, the cutting edge around the die opening is easily worn and the quality and thickness of the material are greatly limited, and the punched product is subject to curvature.

The other embodiment mentioned above is much more durable than the first two mentioned. However, it is very difficult to machine a hard steel band so as to precisely meet the configuration of a product. Also, a precise die opening could not be provided in points of the machining process and the material quality, and a die opening of intricate or sharp shapes could not be formed.

The present invention has been devised to eliminate the above mentioned disadvantages or drawbacks of the prior art.

A primary object of the invention is to provide an improved die which is durable and may be easily formed.

A second object of the invention is to provide a die which is formed with an opening having intricate or sharp shapes for performing high precision work, and with which punching can be carried out in a precise manner without causing curvatures in the products.

A still further object of the invention is to provide a die which has much greater strength in comparison with the conventional die of soft material, and which largely reduces the limitations of the materials which may be worked or the thickness thereof, thus, making the device applicable to a broader range of uses.

A further object of the invention is to provide a die which is suited not only to test shapes and small production, and also to a medium range of production of around 10,000 to 100,000 sheets.

Another object of the invention is to provide a die whose cutting edge may be easily replaced and which has an improved abrasion resistance and is applicable to mass production.

Still another object of the invention is to provide a method which cheaply produces the die having the above-mentioned features in a simple process using a small processing force at low temperatures.

A final object of the invention is to provide a method of manufacturing a die with an ultra-plastic material. Said die easily, rapidly and economically makes use of the merits of the ultra plastic metal, said metal having a deformation resistance which is extremely low. The material does not suffer from low-strength owing to easy plastic deformability. The die is by far superior in stress conditions in comparison with a plastic lost wax mold.

For accomplishing the above-mentioned objects, the invention is comprised of an economical die having a die body soft enough to be easily machined, a thin plate, single or plural, which is harder than the die body and which is superimposed onto a surface of the die. The die has at its center a hole coinciding with a configuration of the product. The superimposed plate is characterized in that it remains after a product has been punched out from said thin plate by the die and the punch.

According to the invention, a product is punched out as a dummy at the beginning of an operation. The punched thin plate is utilized by being superimposed as a cutting edge around the die opening, whereby the soft surface of the die is reinforced. Thus, it is possible to greatly reduce abrasion of the cutting edge or curvature of a product. Thus, this invention eliminates problems present in such dies up to this point. Since materials of good machinability and soft property are adequate for use in the die body, a die opening can be easily machined to form a desired shape. Also, by simply punching it, the thin plate may be easily formed with an opening as a cutting edge. As is seen, the die is economical and easy to manufacture.

Further, in the invention, the surface of the die is fixedly superimposed within a plurality of the thin plates. Upper plates are then removed in succession as the operation advances, thereby improving the durability of the die.

A production of the punching die of the invention is characterized by preparing the punching die body having a determined shape. The body is comprised of a material soft enough to be machined. Next, the body is reinforced by laying a thin plate which is harder than the die body over the body and stamping this plate by means of a punch of ordinary hardened steel material. The punched plate is fixed onto the surface of the die body. Through this process, the punching die may be easily and economically produced.

Many other features, advantages and structures of the present invention will be apparent from the following description of the drawings.

DETAILED DESCRIPTION OF THE INVENTION

The invention will be described with reference to the attached drawings, in order to describe the punching die and a method of its manufacture.

Figure 2:
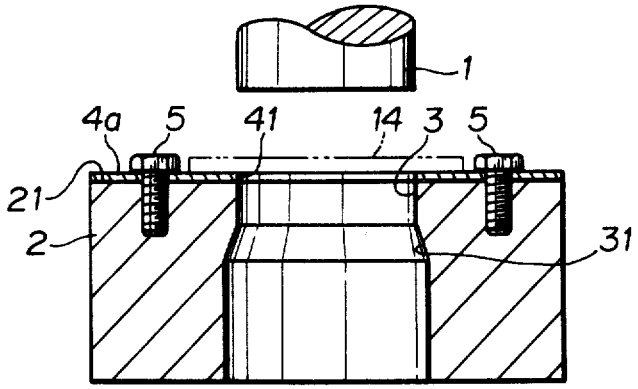

FIG. 2 of the drawings shows a basic example of the punching die of the present invention. The die is composed of a punch 1 of the ordinary hardened steel, which is finished in a determined punching shape, a punching die body 2 comprised of a material which is soft to the extent of being easily machineable, and a punched thin plate 4a which is harder than said die body 2. Plate 4A is formed with a hole 41 coinciding with the configuration in plate of the punch 1. Plate 4a is fixedly superimposed on the surface of the die body 2. The die body 2 is concaved with a female portion 3 which corresponds to the shape of the punch 1. The female portion 3 is defined at its lower part with a relief 31. The punched plate 4a remains in place after a product has been punched out from said thin plate 4.

Figure 3:
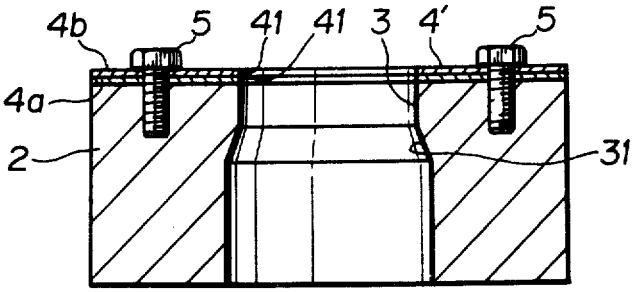
FIG. 3 is a cross-sectional view showing another example of the die according to the invention.

FIG. 3 illustrates another example of the invention where a plurality of the punched plates harder than the die body 2 are fixedly overlapped on the surface of the die body. The other elements correspond to those shown in FIG. 2. FIG. 3 shows the two sheets of the punched plates, but more than two sheets may be included.

Figure 4:
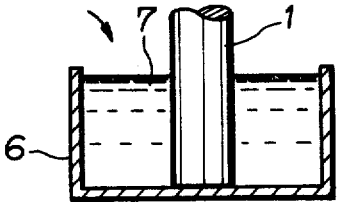
FIG. 4 and FIG. 5 are explanatory views showing other examples of making die bodies in the invention.
Figure 5:
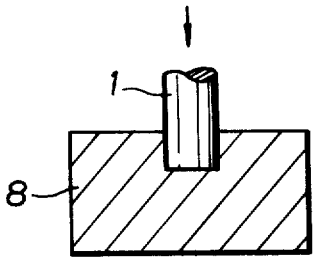

The die body 2 is composed of such materials as are sufficiently soft to enable easy machining. This results in no problems regarding the material quality or its manufacture. In other words, as shown in FIG. 4, a cast die may be provided by positioning a punch 1 in a casting mold 6, into which molten metal 7 of Zn alloy or other metals of low melting points is poured and solidified. Otherwise, as shown in FIG. 5, a die may be made by cold-hobbing by urging the punch 1 into a blank material 8 of soft metal, such as copper or aluminum or a hardened die (not shown). Such a die may be obtained by machining a soft steel or copper to form a female portion.

The punched thin plates 4a and 4b which characterize the invention should be harder than the die body 2 as mentioned above. The material should be selected from the viewpoint of having the strength for a cutting edge to be punched. Preferable materials are materials such as a thin bainite steel plate, or materials having equivalent qualities. A fixing means to the die body or a fixing means between the punched plates may be secured by means of a securing material or by screwings with a plurality of bolts as shown in FIGS. 2 and 3, or by a combination of them, an adhering agent, or fixing bolts to the die set, not shown.

Figure 1:
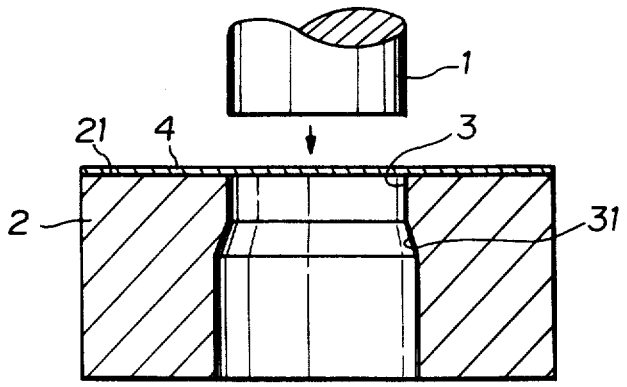
FIGS. 1 and 2 show cross-sectional views of a punching die reinforced by superimposing a hard thin plate.

Next, reference will be made to a manufacture of the punching die. The punch 1 is made of ordinary hardened steel and finished in a determined punching configuration. The die body 2 is made having a concaved female portion 3 corresponding to said configuration in the plane of the punch 1. The material qualities and the productions thereof are as mentioned above. Subsequently, thin plate 4 is laid on a surface 21 of the die body 2, as shown in FIG. 1. The thin plate 4 is harder than the die body, and almost the same in size as the surface of the die onto which the punch 1 is brought down into the female portion 3 of the die 2. Thus, a piece (a product) is stamped out which is the same shape as the configuration of the surfaces of the punch 1 and the opening of the die body. The stamping makes a hole having the same shape as said configuration. This punched plate 4a which remains is secured on the surface 21 of the die body 2. Thus, the production of the punching die is completed. After completing production of the die, a material 14 to be punched is laid on said punched shape 4a fixed on the die body 1 for stamping products by means of the punch 1 and punching shape 4a.

The above mentioned matter refers to a basic process of the invention. A specific example is shown in FIG. 3. A thin plate 4' is placed on the die. The plate 4' is of the same quality as, or different from, the punched shape plate 4a and harder than the die body 2. This thin plate 4' is punched to provide a second punched shape plate 4b. The plate 4b is fixedly superimposed on the first punched shape 4a so that holes 41 coincide with each other. It should be noted that a third, fourth, etc. punched thin plate may be fixedly superimposed in the same way as described above.

The material qualities and manufactures of the soft die body 2 are aribtrary. In order to make apparent the objects of the invention, it is recommended to associate a soft die body with said punched thin plates 4a, 4a and 4b, in which a die blank is an ultra-plastic metal of Zn-22%Al capable of becoming very hard after a hardening treatment. Said blanks are formed by the hot hobbing process.

The ultra plastic metal has an extremely low deformation resistance. It is used for the materials forming various kinds of parts because of its easy workability. However, due to its nature, its practical applications have only been to the plastic casting mold or the plastic lost wax mold. However, in the present invention, this technique has been overcome such that the ultra-plastic metal is employed in a punching die, which has far greater stress conditions in comparison with the above casting molds; thus, taking full advantage of the easiness and rapidity of the die production. Also, the strength of the die may be greatly improved, which brings about high accuracy and durability of the cutting edge.

FIGS. 6(A) to 6(I) show a manufacturing process of the punching die by the combination of the die body 1 of the ultra plastic metal and the punched hard thin plates 4a, 4a and 4b. At first, the ultra plastic material of Zn-22%Al is machined to provide a blank material 9 of a determined size like a disc (FIG. 6(A)). The blank material 9 is heated with an appropriate means to temperatures of about 230°-270° C. where the material shows an ultra plasticity and where the deformation resistance is at the minimum (FIG. 6(B)). In the meantime, while keeping said temperatures, the punch 1 is forced into the blank material 9 at low speed by means of a hydraulic press 10 to carry out the hot hobbing (FIG. 6(C)). The blank material 9 is positioned within a container 12 to restrain lateral expansion, and a female portion 3 meeting the configuration of the punch 1 is formed. The force required at this time is about 1/10 to 1/20 of that which is required at room temperature.

Figure 6A:
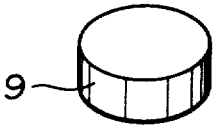
FIGS. 6(A)–6(I) are explanatory views showing, in the processing order, a manufacture of a punching die according the invention where the ultra-plastic metal is used for the die body.
Figure 6B:
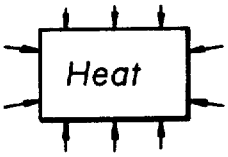
Figure 6C:
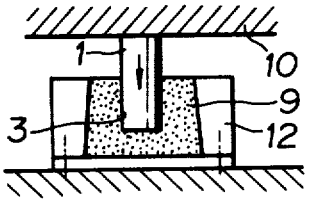
Figure 6D:
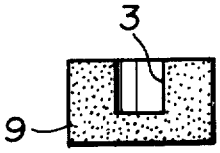
Figure 6E:
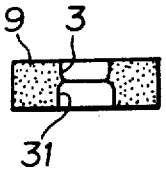
Figure 6F:
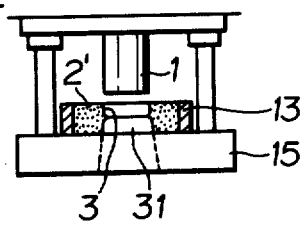
Figure 6G:
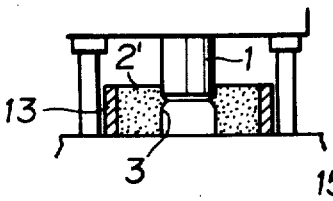
Figure 6H:
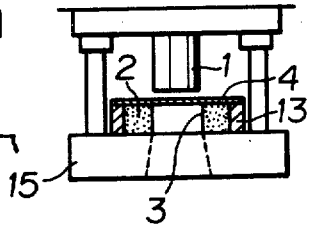
Figure 6I:
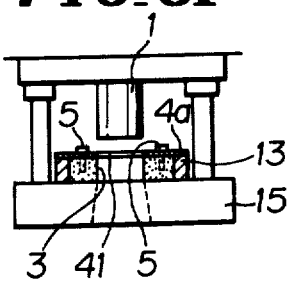

As is seen in FIG. 6(D), the blank material 9 is taken out from the container 12. It is then taken as is, or after re-heating and rapidly water-cooled to provide hardening. After hardening the upper and lower faces are cut or ground, and a relief 31 is formed. The die set supporting holes (not shown) are pierced (FIG. 6(E)). This half-finished die body 2' is furnished with a die ring 13 and is provided on a die set 15 as shown in FIG. 6(F). The punch 1 is again brought down as seen in FIG. 6(G) into the female portion (3) to perform a shaving of an inner side thereof. This is because the size of the die body is made less than the outer diameter of the punch owing to the cooling and heating treatment. A die body of zero clearance is provided by this shaving. After reaching this condition, the hard thin plate 4 is put on the surface of the die body 1 as shown in FIG. 6(H). The plate 4 is punched by the punch 1 and the die body 2. The shaped punched plate 4a which remains is fixed thereon as viewed in FIG. 6(I).

Referring now to the operating of the punching die, actual examples will be shown as follows:

EXAMPLE 1

Figure 7:
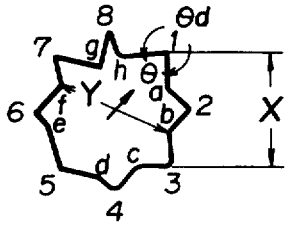
FIG. 7 is an explanatory view showing a configuration of a product in an example carrying out the punching in accordance with the invention.

(I) Punch 1: SKD-1 hardened in $H_RC58$ and ground.
Die Body 2: Zn-22%Al ultra plastic material.
Laying thin plate 4: Bainite.
Shape and size of punching hole: FIG. 7 and Table 1.

Table 1

| A | 1 | 2 | 3 | 4 | 5 | 6 | 7 | 8 |
|---|---|---|---|---|---|---|---|---|
| θ° | 90 | 90 | 90 | 90 | 120 | 90 | 60 | 30 |
| Rmm | 0.1 | 0.2 | 0.8 | 1.4 | 0.4 | 0.4 | 0.4 | 0.4 |
| B | a | b | c | d | e | f | g | h |
| θ° | 225 | 225 | 225 | 210 | 210 | 240 | 270 | 255 |
| Rmm | 0.1 | 0.4 | 3.2 | 1.6 | 0.4 | 0.4 | 0.4 | 1.6 |

A: Convex
B: Concave (II) The ultra plastic blank material for the die body 2 was heated at about 250° C. While maintaining this temperature, a punch finished in said shape and size was urged into the blank material to form a female portion 3. After this hot hopping, the blank die was rapidly water-cooled. Subsequently, it was cut at its upper and lower faces, as well as formed with a relief 31 in the female portion 3. In this condition, it was set into the die set and the shaving was performed by means of the punch 1. The thin plate 4 referred to in the above item (I) was laid on the surface of the die body 2 and punched and fixedly screwed thereon with bolts 5. The entire process takes less than one hour. In this regard, the shape punched plate 4a was more preferable the higher the hardness and the thicker the plate in view of the strength of the cutting edge and abrasion resistance. But in the inventors investigations, no problems occurred in a case of 0.2 mm t (Hv 467) and 0.5 mm t (Hv 390). (III) The punching was actually performed with the shape punched plate 4a (one sheet of 0.5 mm t). The materials to be punched were three kinds of 0.8 mm t ($\sigma_B$=27 Kg/mm$^2$ and 45% elongation), SPC of 1.6 mm t ($\sigma_B$=32 Kg/mm$^2$ and 52% elongation, and a high tension steel plate of 1.6 mm t ($\sigma_B$=60 Kg/mm$^2$), and life tests of 1000 times were carried out, respectively.

Figure 8:
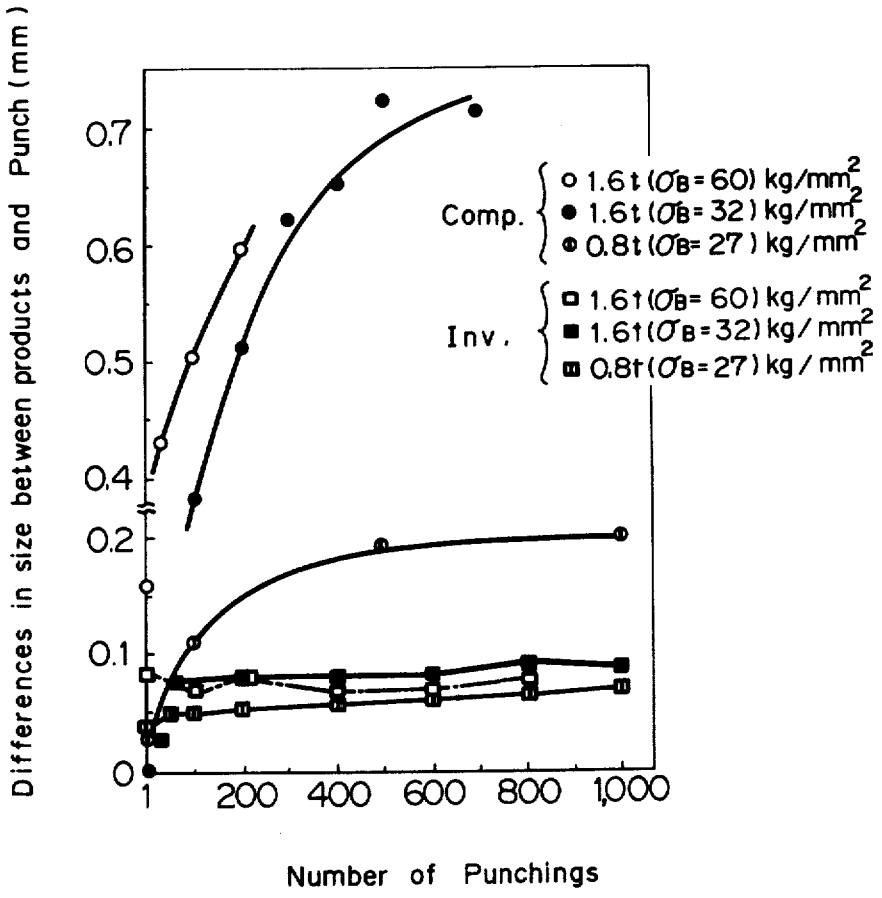
FIG. 8 shows graphs illustrating changes in sizes of the products caused in the punching number; showing the comparison of an instance using a punched plate and an instance not using it.

For comparing the present invention, the ultra plastic die without using the hard thin plate was subjected to the same test, and FIG. 8 shows comparisons of changes in the sizes of the products (abrasions of the shapes) with regard to right-angled portions of the punched holes. As clearly shown in FIG. 8, the reinforcing effect is very good. Also, the difference in size by abrasion is reduced greatly in comparison with that of not using the shaped punched plate. Especially in the case of using the shaped punched plate, the changes of difference in size are little as the number of punching increases. This is because the cutting edge has enough hardness and abrasion resistance. Therefore, it is possible to expect size precision for materials in general when carrying out a medium amount of production.

Figure 9:
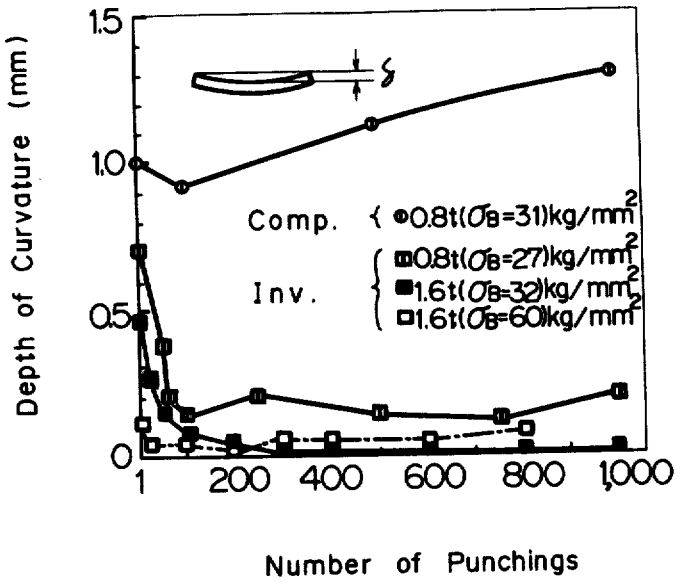
FIG. 9 are graphs showing the relationships of the punching number and depths of curvatures of the products in comparison with an instance of using a punched plate and an instance of not using it.

(VI) FIG. 9 shows results based on the comparisons and investigations with regard to the degree of curvatures of the punched products. The graph compares the case of using the shape punched plate and that of not using it. As shown in FIG. 9, the punched products have curvatures at the beginning of the operation according to the invention. However, these degrees of curvatures are very low in comparison with the case of not using the shaped punched plate. In the invention, the curvature is greatly reduced when 50 to 100 punchings are performed. That is, in the case of the ultra plastic die without the shaped punched plate, the depth of the curvature after 1000 times is about 1.3 mm and, in the invention, it is possible to reduce about 1/6 thereof. The curvature of the product is caused by the fact that size of the female portion is most enlarged at the cutting corner of the die body owing to abrasion and the punched part having a diameter which is urged within the female portion.

Figure 10:
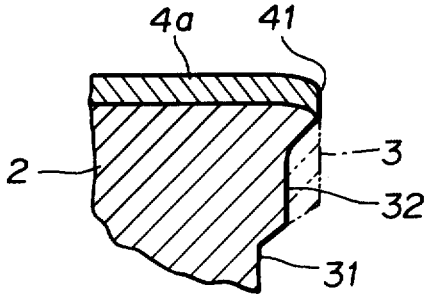
FIG. 10 is an explanatory view showing abrasions of the punching die of the invention.

On the other hand, the invention cutting edge is composed of the hard thin plates 4a, 4b and the abrasion is, as shown in FIG. 10, generated in the side wall of the female portion of the soft die body 2. Therefore, the curvature is formed at the beginning due to the abrasion in the side wall. But after an abrasion is formed in some degree, an appropriate relief 32 is formed thereby and thus the curvature of the product is extinguished.

(V) The inventors made use of the zero clearance of the punching die of the roundness at the edges of the thin plates 4a, 4b, and further practiced the finished punchings on the non-ferrous metallic materials, such as pure copper or pure aluminum. The result obtained was that, in each of 4 mm t and 2 mm t of the pure aluminum and 3 mm t and 2 mm t of the pure copper, the cut face reveals shearing. Thus, it has been found that this invention also succeeded in providing finished punching and precision shearing with respect to the non-ferrous metallic materials.

EXAMPLE 2

Figure 11:
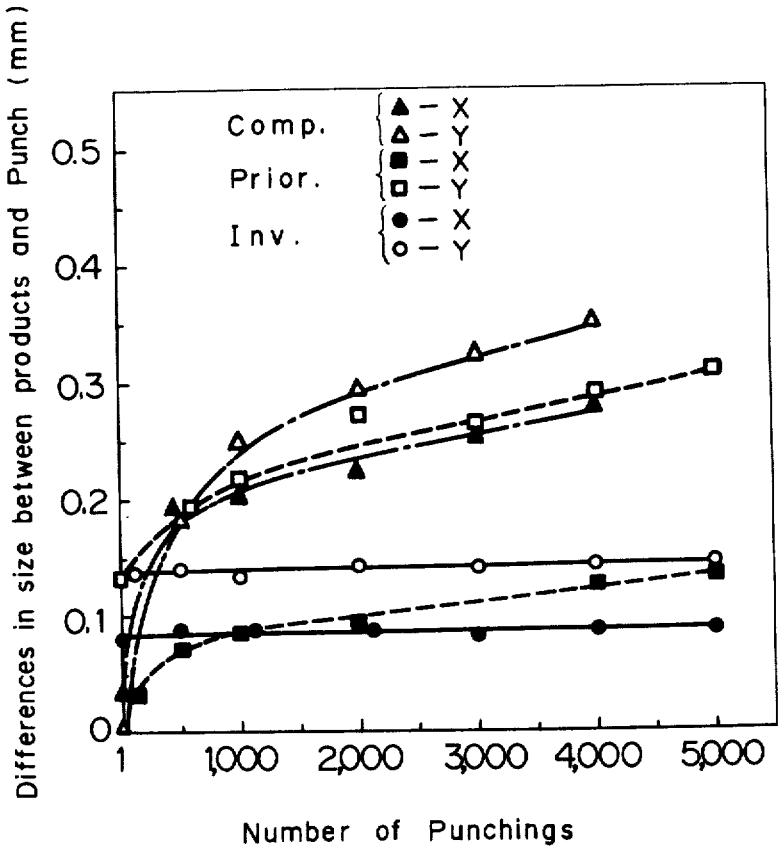
FIG. 11 is a graph showing test results of use of the applicant's punching die, together with those prior art devices previously described.

(I) The conditions of the die body, the punch and the punched configuration were the same as in Example 1. The thin bainite steel plates of 0.5 mm, 0.8 mm and 1.0 mm in thickness were put on the surface of the die body 2 and punched by the punch 1. Those punched plates remaining were superimposed on the surface of the die body 1, and such a punching die (edge thickness 3.3 mm) was provided which was composed of four sheets (one sheet: 0.5 mm, one hseet: 0.8 mm and two sheets: 1.0 mm) of the punched thin plates. (II) Subsequently, the punching was carried out with the above-obtained die. The plate to be punched was the hot-rolled steel (2.3 mm t) and the test was done up to 5000 times. For comparing the invention, the cold rolled steel plates of 0.8 mm t were punched by means of the die (comparison) of the ultra-plasticity without the hard thin plate and the die (foregoing). (III) The results are shown in FIG. 11 in respect to the changes in size owing to (the abrasion of the die) in the right angled portions of the punched products and the concaves. As can be easily seen in FIG. 11, the invention greatly reduced the difference in size through punching a thickness three times those of the comparative and the foregoing ones. Also, the difference in size at the concaves was considerably smaller.

We claim:

1. A method of manufacturing an easy punching die reinforced by a superimposed thin plate of hard properties, comprising the steps of:

(a) preparing a punching die body, said body comprised of a material which is easily machinable, said body being manufactured by means of a hobbing process;

(b) superimposing on a surface of said punching die body, a thin plate harder than said die body;

(c) punching said thin plate by means of a hardened steel punch; and (d) fixing said punched thin plate onto said surface of said die body.

2. A method of manufacture as set forth in claim 1 wherein said fixing of said punched plate onto said surface of said die body is performed by means of bolts.

3. A method of manufacturing an easy punching die as set forth in claim 1 wherein said punching die body is comprised of an ultra-plastic material, and said preparing step is further comprised of heating a blank material of said ultra-plastic material to temperatures where said material shows an ultraplasticitity and its deformation resistance is at a minimum, said step further comprising urging a punch finished in a predetermined shape into said heated ultra-plastic blank material, while maintaining said temperature, thereby forming a female portion therein, said preparing step further comprising:

hardening the blank material, finishing an upper and lower face on said die body by means of cutting, setting said die body into a die set and shaving said die body by means of a punch.

4. A method as set forth in claim 1 wherein said thin plate is comprised of steel bainite.

5. A method as set forth in claim 1 wherein said die body is comprised of Zn-22%Al.

6. A method of manufacturing an easy punching die as in claim 1 further comprising the steps of:

(e) superimposing on a surface of said fixed punched thin plate a second thin plate harder than said die body;

(f) punching said second thin plate by means of said steel punch;

(g) fixing said punched second thin plate onto said surface of said fixed punched thin plate.

* * * * *